US007140270B2

(12) United States Patent
Smith et al.

(10) Patent No.: US 7,140,270 B2
(45) Date of Patent: Nov. 28, 2006

(54) ADJUSTABLE PEDAL SYSTEM HAVING A SLOT-LINK MECHANISM

(75) Inventors: Gordon Smith, Lake Orion, MI (US); Srini Sundaresan, Troy, MI (US); Akhil Mahendra, Rochester Hills, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 481 days.

(21) Appl. No.: 10/462,109

(22) Filed: Jun. 13, 2003

(65) Prior Publication Data

US 2004/0250646 A1 Dec. 16, 2004

(51) Int. Cl.
*G05G 1/14* (2006.01)

(52) U.S. Cl. ..... 74/512

(58) Field of Classification Search ..... 74/512, 74/513, 560

See application file for complete search history.

(56) References Cited

U.S. PATENT DOCUMENTS 4,875,385 A * 10/1989 Sitrin ..... 74/512
6,173,625 B1 * 1/2001 McFarlane et al. ..... 74/512
6,324,939 B1 * 12/2001 Cicotte ..... 74/512
6,367,349 B1 4/2002 Allen ..... 74/512
6,443,028 B1 * 9/2002 Brock ..... 74/512
6,520,045 B1 2/2003 Fukase ..... 74/512
6,782,776 B1 * 8/2004 Oberheide et al. ..... 74/512
2002/0078784 A1 6/2002 Hayashihara ..... 74/512

* cited by examiner

*Primary Examiner*—Chong H. Kim
(74) *Attorney, Agent, or Firm*—Richard M. Mescher; Porter Wright Morris & Arthur; Dean B. Watson

(57) ABSTRACT

A pedal assembly includes a booster link, a support having a slot formed therein, a guide moveable along the slot, and a single lead screw and nut connected to the guide to move the guide along the slot. A brake pedal includes a brake lower pedal arm pivotally connected to the guide, a first pedal at a lower end of the brake lower pedal arm which is adjustable upon movement of the guide, and a brake link pivotably connecting the brake lower pedal arm with the booster link. An accelerator pedal includes an accelerator upper pedal arm pivotably connected to the guide, an accelerator link pivotably connecting the accelerator upper pedal arm to the support, an accelerator lower pedal arm pivotably connected to the accelerator upper pedal arm, and a second pedal at a lower end of the second lower pedal arm which is adjustable upon movement of the guide.

36 Claims, 7 Drawing Sheets

ADJUSTABLE PEDAL SYSTEM HAVING A SLOT-LINK MECHANISM

CROSS-REFERENCE TO RELATED APPLICATIONS

Not Applicable.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to control pedals for a motor vehicle and, more particularly, to control pedals which can be selectively adjusted to desired positions in a forward/rearward direction.

BACKGROUND OF THE INVENTION

Control pedals are typically provided in a motor vehicle, such as an automobile, which are foot operated by the driver. Separate control pedals are provided for operating vehicle brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the seat to the most advantageous position for working a steering wheel, the control pedals on other control devices of the motor vehicle.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the resulting position of the seat may still be uncomfortable for some drivers. Therefore, it is desirable to have an additional or alternate adjustment method for accommodating drivers of various size.

Many proposals have been made to selectively adjust the position of the control pedals relative to the steering wheel and the front seat in order to accommodate drivers of various size. While these adjustable control pedals may adequately adjust the position of the control pedal to accommodate drivers of various size, these adjustable control pedals may be unreliable, noisy and expensive to produce. Additionally, these adjustable control pedals may require expensive sensors or switches in order to maintain a desired positional relationship between the pedals at all positions. Furthermore, many of these adjustable control pedals are not easily customized to meet varying vehicle or floor pan requirements. Accordingly, there is a need in the art for an improved adjustable control pedal assembly which selectively adjusts the position of the pedal to accommodate drivers of various size.

SUMMARY OF THE INVENTION

The present invention provides an adjustable control pedal assembly and a method of operating an adjustable control pedal assembly which overcomes at least some of the above-noted problems of the related art. According to the present invention, a control pedal assembly includes, in combination, a pivotable booster link, a support having a slot formed therein, a guide moveable along the slot in a fore aft direction, and a drive assembly operably connected to the guide to selectively move the guide along the slot in a fore-aft direction. A first control pedal includes a first lower pedal arm pivotally connected to the guide, a first pedal at a lower end of the first lower pedal arm which is adjustable in a fore-aft direction upon movement of the guide, and a first link pivotably connecting the first lower pedal arm with the booster link. A second control pedal includes an upper pedal arm pivotably connected to the guide, a second link pivotably connected to the upper pedal arm, a second lower pedal arm pivotably connected to the upper pedal arm, and a second pedal at a lower end of the second lower pedal arm which is adjustable in a fore-aft direction upon movement of the guide.

According to another aspect of the present invention, a control pedal assembly includes, in combination, a booster link pivotably mounted at a fixed pivot axis, a support having a slot formed therein, a guide moveable along the slot in a fore aft direction, and a drive assembly operably connected to the guide to selectively move the guide along the slot in a fore-aft direction. A control pedal includes a lower pedal arm pivotally connected to the guide, a pedal at a lower end of the lower pedal arm which is adjustable in a fore-aft direction upon movement of the guide, and a link pivotably connecting the first lower pedal arm with the booster link.

According to yet another aspect of the present invention, a control pedal assembly includes, in combination, a support and a drive assembly. The drive assembly includes a lead screw connected to the support, a drive nut cooperating with the lead screw for linear movement along the lead screw upon rotation of the lead screw, and a drive motor operably connected to lead screw for selectively rotating the lead screw to move the drive nut along the lead screw. A first control pedal includes a first lower pedal arm secured to the drive nut and a pedal at a lower end of the lower pedal arm which is adjustable in a fore-aft direction upon movement of the drive nut along the lead screw. A second control pedal includes an upper pedal arm secured to the drive nut, a second lower pedal arm pivotably connected to the upper pedal arm, and a second pedal at a lower end of the second lower pedal arm which is adjustable in a fore-aft direction upon movement of the drive nut along the lead screw.

According to even yet another aspect of the present invention, a control pedal assembly includes, in combination, a booster link pivotably mounted at a fixed pivot axis, a fixed-position support having a slot formed therein, and a guide moveable along the slot in a fore aft direction. A drive assembly includes a lead screw, a drive nut secured to the drive nut and cooperating with the lead screw for linear movement along the lead screw upon rotation of the lead screw, and a drive motor operably connected to lead screw for selectively rotating the lead screw to move the drive nut along the lead screw. Movement of the drive nut along the drive screw moves the guide along the slot in a fore-aft direction. A brake pedal includes a brake lower pedal arm pivotally connected to the drive nut, a first pedal at a lower end of the brake lower pedal arm which is adjustable in a fore-aft direction upon movement of the guide, and a brake link pivotably connecting the brake lower pedal arm with the booster link. An accelerator pedal includes an accelerator upper pedal arm pivotably connected to the drive nut, an accelerator link pivotably connecting the accelerator upper pedal arm to the support, an accelerator lower pedal arm pivotably connected to the accelerator upper pedal arm, and a second pedal at a lower end of the second lower pedal arm which is adjustable in a fore-aft direction upon movement of the guide.

From the foregoing disclosure and the following more detailed description of various preferred embodiments it will be apparent to those skilled in the art that the present invention provides a significant advance in the technology and art of adjustable control pedal assemblies. Particularly significant in this regard is the potential the invention affords for providing a high quality, feature-rich, low noise, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
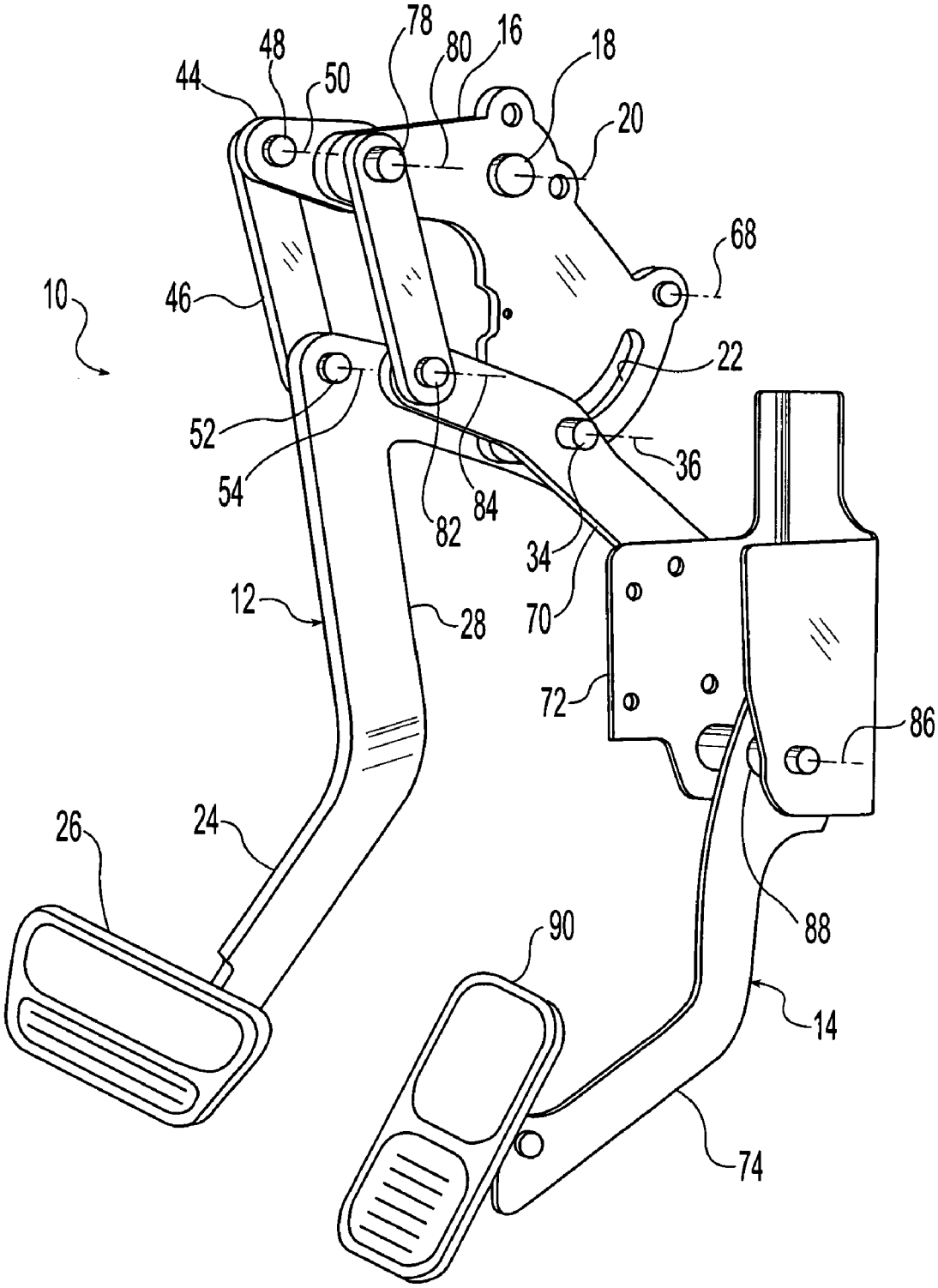
FIG. 1 is a right-rear perspective view of an adjustable control pedal assembly according to the present invention having brake and accelerator pedals wherein the pedals are positioned in a full rearward position.

It should be understood that the appended drawings are not necessarily to scale, presenting a somewhat simplified representation of various preferred features illustrative of the basic principles of the invention. The specific design features of a control pedal assembly as disclosed herein, including, for example, specific dimensions and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIG. 1 and down or downward refers to a down direction in the plane of the paper in FIG. 1. Also in general, fore or forward refers to a direction toward the front of the motor vehicle and aft, rear, or rearward refers to a direction toward the rear of the motor vehicle.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved control pedal assemblies disclosed herein. The following detailed discussion of various alternative and preferred embodiments will illustrate the general principles of the invention with reference to a control pedal assembly for use with a motor vehicle. Other embodiments suitable for other applications will be apparent to those skilled in the art given the benefit of this disclosure.

Figure 2:
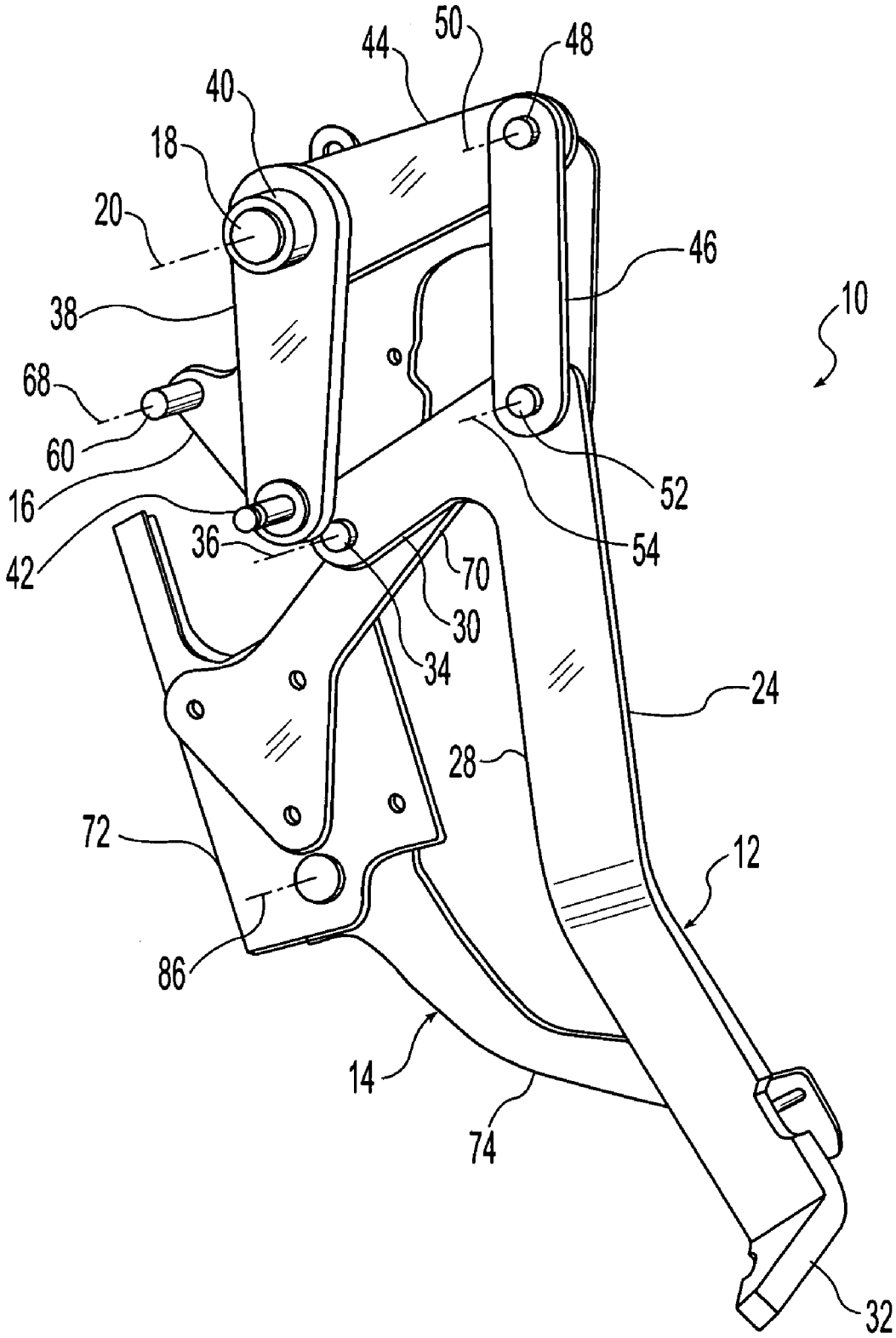
FIG. 2 is a left-rear perspective view of the adjustable control pedal assembly of FIG. 1.
Figure 3:
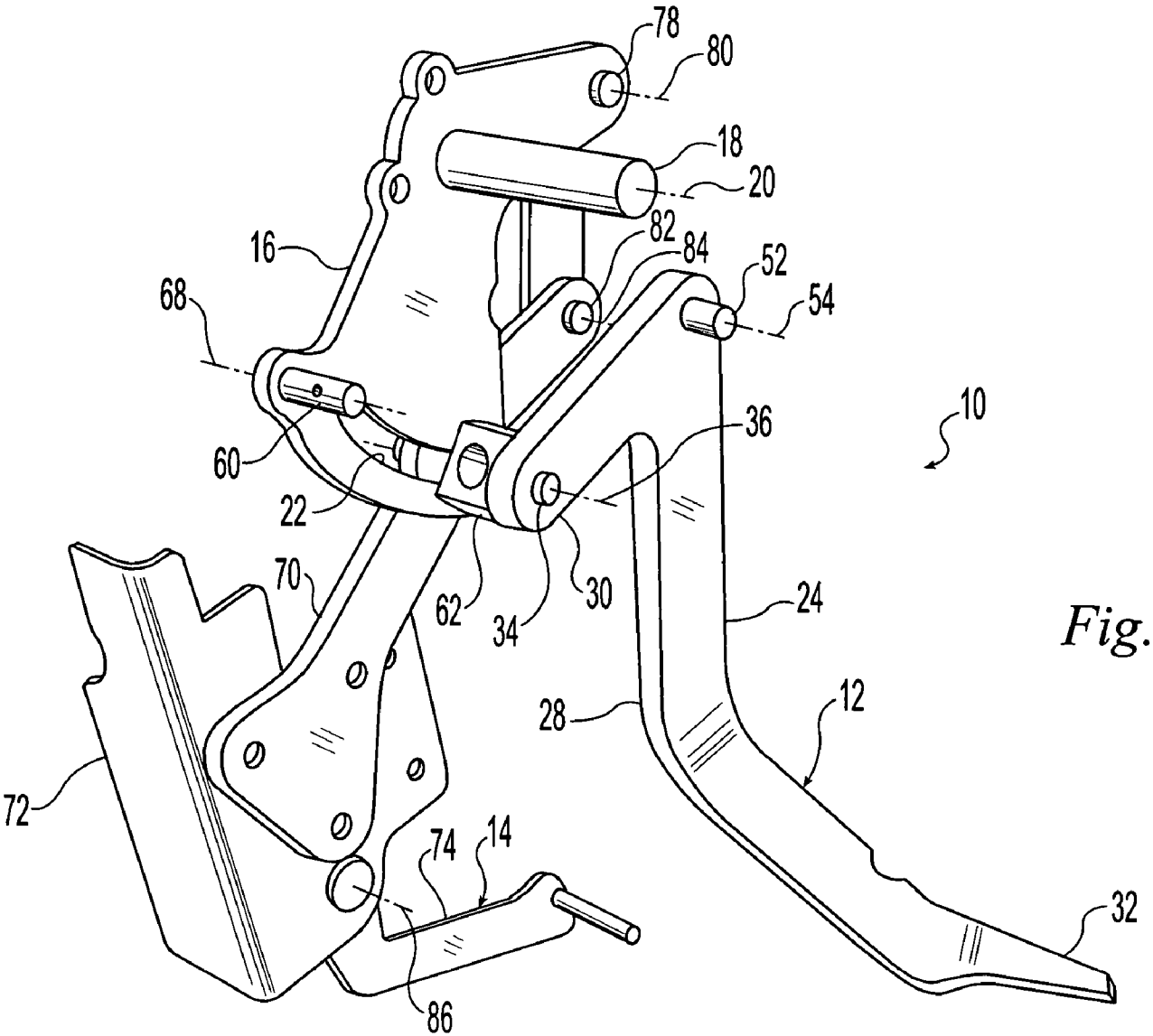
FIG. 3 is a right-forward perspective view of the adjustable control pedal assembly of FIGS. 1 and 2 with some components removed for clarity.

Referring now to the drawings, FIGS. 1 to 3 show a control pedal assembly 10 for a motor vehicle, such as an automobile, according to the present invention which is selectively adjustable to a desired position by a driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The illustrated control pedal assembly 10 includes a brake pedal 12 and an accelerator pedal 14 which are together adjustable relative to a stationary or fixed-position support or upper arm 16. The support 16 is sized and shaped for attachment to a stationary support or mounting bracket. The mounting bracket is rigidly attached and/or the support 16 is rigidly secured to a firewall or other rigid structure of the motor vehicle in a known manner. The illustrated support 16 is generally an elongate plate oriented in a vertical and forward-rearward plane such that opposed planar sides of the plate are facing opposed lateral directions. Laterally extending from the support is a horizontal brake pin or pivot 18 forming a fixed-position, laterally and horizontally extending pivot axis 20. The illustrated brake pivot extends only in the left direction toward the brake pedal 12. Formed in the support 16 is a single slot 22 generally extending in the forward rearward direction. The illustrated slot 22 is generally arcuate or curved in a downwardly concave manner, that is the center of curvature is located above the slot 22. The illustrated slot 22 is also downward sloping in a rearward direction, that is, the forward end of the slot 22 is located higher than the rearward end of the slot 22. It is noted that over suitable configurations and orientations of the slot 22 can be utilized within the scope of the present invention such as, for example, the slot 22 could be straight, horizontal, and/or any other suitable shape or orientation.

The brake pedal 12 includes a brake lower arm 24 and a brake pedal or pad 26. The brake lower arm 24 is sized and shaped for selected fore and aft movement along the slot 22 of the support 16. The brake lower arm 24 is generally an elongate plate oriented forward-rearward and vertical plane so that it is generally parallel to the support. The brake lower arm 24 has a an elongate main portion 28, a pivot portion 30 extending from the top of the main portion 28, and a pedal portion 32 laterally extending from the bottom of the main portion 28. The pivot portion 30 generally rearwardly extends from the top of the main portion 28. The rearward end of the pivot portion 30 is provided with an opening for receiving a guide or pivot pin 34. The guide 34 laterally and horizontally extends from the slot 22 and forms a horizontal and laterally extending pivot axis 36 for the brake lower arm 24. The guide 34 is sized and shaped for cooperation with the slot 22 of the support 16 as discussed in more detail hereinafter. The brake pedal 26 is located at a lower end of the brake lower arm 24 and secured to the pedal portion 32 of the lower arm 24. The brake pedal 26 is adapted for depression by the driver of the motor vehicle to pivot the brake lower arm 24 about the pivot axis 36 to obtain a desired control input to the brake system of the motor vehicle. It is also noted that while the illustrated brake pedal 26 is formed separate and attached to the lower arm, the brake pedal 26 can be formed unitary with the brake lower arm 24 within the scope of the present invention.

A booster link 38 is pivotably mounted on the brake pivot 18 along with a brake hub 40 so that the booster link 38 is pivotable about the pivot axis 20 formed by the brake pivot 18. The illustrated booster link 38 downwardly extends from the brake pivot 18 and is provided with a booster pin 42 at its lower end. The booster pin 42 is suitably connected to the vehicle brake system so that pivoting motion of the booster link 38 operates the vehicle brake system in a desired manner. A support link 44 is also pivotably mounted on the brake pivot 18 along with the brake hub 40 and the booster pivot 38 so that the support link 44 is also pivotable about the pivot axis 20 formed by the brake pivot 18. The illustrated support link 44 is rigidly secured to the brake hub 40, the booster link 38 and the booster pin 42 so that they pivot together in unison about the pivot axis 20 with no relative motion therebetween. The illustrated support link 44 rearwardly and upwardly extends from the upper end of the booster link 38 at the pivot axis 20. It is noted that while the illustrated booster link 38, brake hub 40, booster pin 42 and support link 44 are formed as separate components and integrally attached together, all or any combination of these components can alternatively be formed as a unitary component within the scope of the present invention.

A brake link 46 connects the support link 44 and the brake lower arm 24. A first or upper end of the brake link 46 is pivotably attached to the rearward end of the support link 44 by a first brake link pivot or pin 48 forming a laterally and horizontally extending pivot axis 50. A second or lower end of the brake 46 is pivotably attached to the upper end of the brake lower arm 24 by a second brake link pivot or pin 52 forming a laterally and horizontally extending pivot axis 54. Connected in this manner, pivotable motion of the brake lower arm 24 about the pivot axis 36 is transferred to the booster link 38 and booster pin 42 through the support link 44 and the brake link 46.

Figure 7:
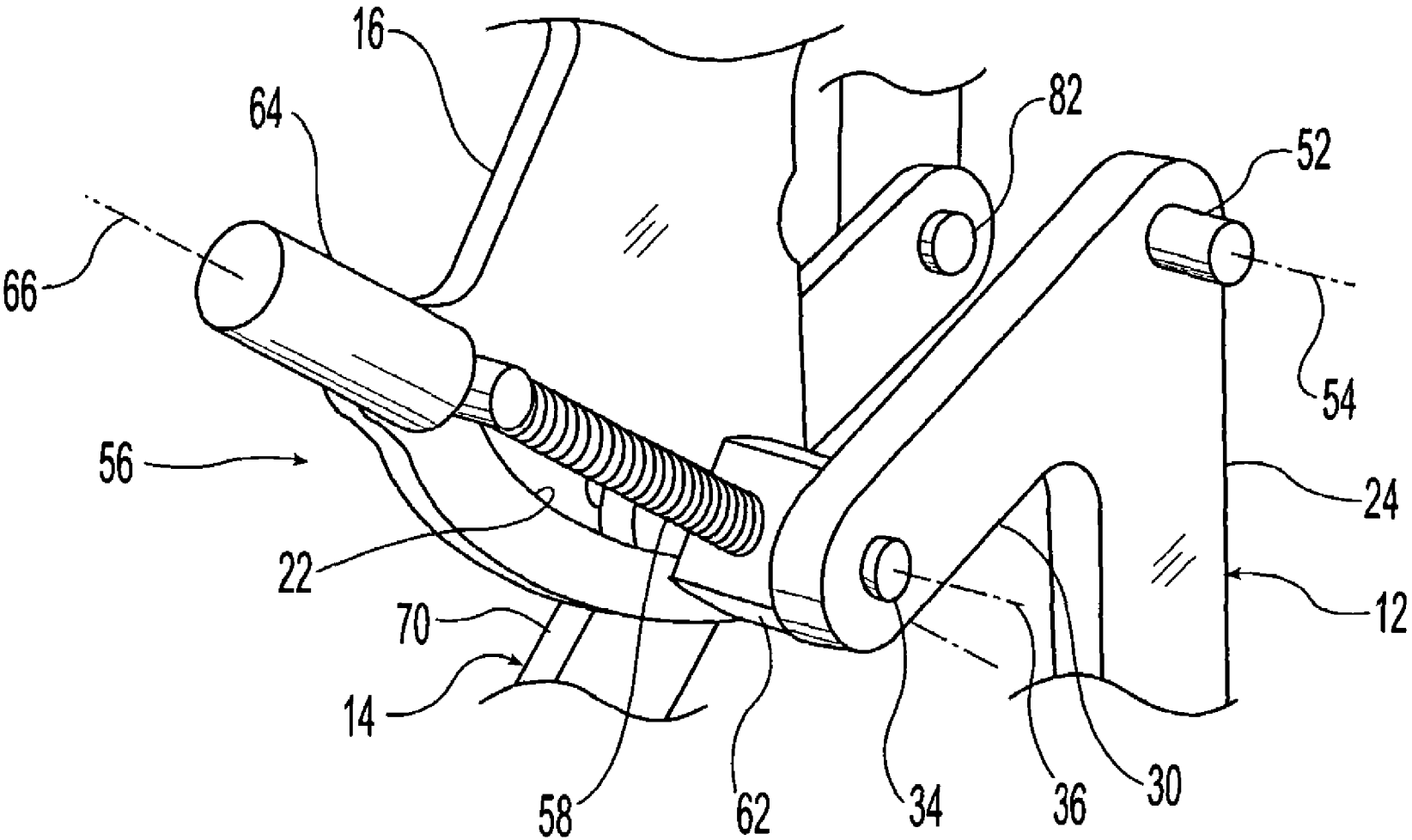
FIG. 7 is an enlarged, fragmented perspective view showing a drive system of the control pedal assembly of FIGS. 1 to 6.

As best shown in FIG. 7, a linear drive assembly 56 includes a drive or lead screw 58, a lead screw housing or attachment 60 for securing the lead screw 58 to the support 16, a drive nut or block 62 of the guide 34 which is adapted for linear longitudinal movement along the lead screw 58 in response to rotation of the lead screw 58, and an electric motor 64 for rotating the lead screw 58. It is noted that the single lead screw 58 and drive nut 64 adjusts both of the pedals 12,14. The lead screw 58 is an elongate shaft having a threaded portion adapted for cooperation with the drive nut 62. The lead screw 58 is preferably formed of resin such as, for example, NYLON but can be alternately formed of a metal such as, for example, steel. The forward end of the lead screw 58 is provided with a bearing surface which cooperates with the lead screw housing 60 to support the lead screw 58 and to attach the lead screw 58 to the support 16. The lead screw 58 is supported for rotation about a central longitudinal axis of rotation 66 of the lead screw 58. The lead screw housing 60 is pivotably attached to the support 16 about a laterally extending pivot axis 68.

The motor 64 is preferably directly coupled to the lead screw 58 at the lead screw housing 60 for selectively rotating the lead screw 58. It is noted that the motor 64 can alternatively be located elsewhere and coupled to the lead screw 58 via a flexible cable in a known manner. The lead screw 58 is connected to an output shaft of the motor 64. It is noted that suitable gearing can be provided between the motor 64 and the lead screw 58 as necessary depending on the requirements of the assembly 10. The drive motor 64 is preferably connected to a suitable control circuit having operator input devices for selectively operating the motor to position the pedals 12, 14 in desired positions.

The drive nut or block 62 has a threaded opening sized and shaped to cooperate with the lead screw 58 so that the drive block linearly moves along the length of the lead screw 58 in response to rotation of the lead screw 58. The drive nut 62 is preferably molded of a suitable plastic material such as, for example, NYLON but can alternatively be formed of metal such as, for example steel. The illustrated drive block 62 is a portion of the guide 34 such that the guide 34 moves along the slot 22 as the drive block 62 moves along the lead screw 58 in response to rotation of the lead screw 58. It is noted that the guide 34 and the drive block 62 can be formed unitary or as separate components rigidly secured together.

The drive assembly 56 is provided with self-aligning joints to promote smooth motion and prevent binding as the guide 34 moves along the slot 22. In the illustrated embodiment, the drive block 62 and guide 34 are free to pivot relative to the brake lower arm 24 about the pivot axis 36 and the lead screw housing 60 is free to pivot relative to the support 16 about the pivot axis 68. It is noted that alternatively other suitable self-aligning joints can be utilized and in some embodiments may not be needed such as those embodiments having a straight slot.

The accelerator pedal 14 includes an accelerator upper arm 70 movable relative to the support 16, an accelerator mounting bracket 72 rigidly secured to the accelerator upper arm 70, and an accelerator lower arm 74 pivotably mounted to the accelerator mounting bracket 72. The accelerator upper arm 70 is sized and shaped for selected fore and aft movement along the slot 22 of the support 16. The accelerator upper arm 70 is generally an elongate plate oriented in a forward-rearward and vertical plane so that it is generally parallel to the support 16. The lower end of the accelerator upper arm 70 is rigidly secured to the accelerator mounting bracket 72 to prevent relative movement therebetween so that the accelerator mounting bracket 72 moves in unison with the accelerator upper arm 70. It is noted that while the illustrated accelerator upper arm 70 and accelerator mounting brackets 72 are formed as separate components and rigidly secured together, the accelerator upper arm 70 and the accelerator mounting bracket 72 can be alternatively formed as a unitary component. An intermediate portion of the accelerator upper arm 70 is provided with an opening for receiving the guide 34 therein at a right side of the support 16, that is, the side of the support 16 opposite of where the brake lower arm 24 is connected to the guide 34. The guide 34 laterally and horizontally extends from the slot 22 and forms the horizontal and laterally extending pivot axis 36 for the accelerator upper arm 70.

An accelerator link 76 connects the support 16 and the accelerator upper arm 70. A first or upper end of the accelerator link 76 is pivotably attached to the rearward end of the support 16 by a first accelerator link pivot or pin 78 forming a laterally and horizontally extending pivot axis 80. A second or lower end of the accelerator link 76 is pivotably attached to the upper end of the accelerator upper arm 70 by a second accelerator link pivot or pin 82 forming a laterally and horizontally extending pivot axis 84. Connected in this manner, motion of the guide 34 along the slot 22 moves the brake lower arm 24 and the accelerator upper arm 70 in the same manner in unison and thereby maintains the desired positional relationship between the brake pedal 12 and the accelerator pedal 14.

The accelerator lower arm 74 is pivotably mounted to the accelerator mounting bracket 72 such that the accelerator lower arm 74 is pivotable about a horizontal and laterally extending pivot axis 86 which is fixed in position relative to the accelerator upper arm 70 and the accelerator mounting bracket 72. Preferably suitable electronic throttle control sensor (ETC) sensor 88 is provided which generates electronic signals representative of the pivoting motion of the accelerator lower arm 74. The sensor is suitably connected to send the electronic signals to the vehicle throttle system so that pivoting motion of the accelerator lower arm 74 operates the vehicle throttle system in a desired manner. See U.S. Pat. No. 6,360,631 and U.S. patent application Ser. No. 10/041,411, the disclosures of which are expressly incorporated herein in their entireties, for examples of suitable ETC accelerator pedal configurations.

The accelerator lower arm 74 is provided with a pedal or pad 90 located at a lower end of the accelerator lower arm 74 and is adapted for depression by the driver of the motor vehicle to pivot the accelerator lower arm 74 about the pivot axis 86 to obtain a desired control input to the throttle system of the motor vehicle. It is also noted that while the illustrated accelerator pedal 90 is formed separate and attached to the lower arm 74, the accelerator pedal 90 can be formed unitary with the lower arm 74 within the scope of the present invention.

Figure 4:
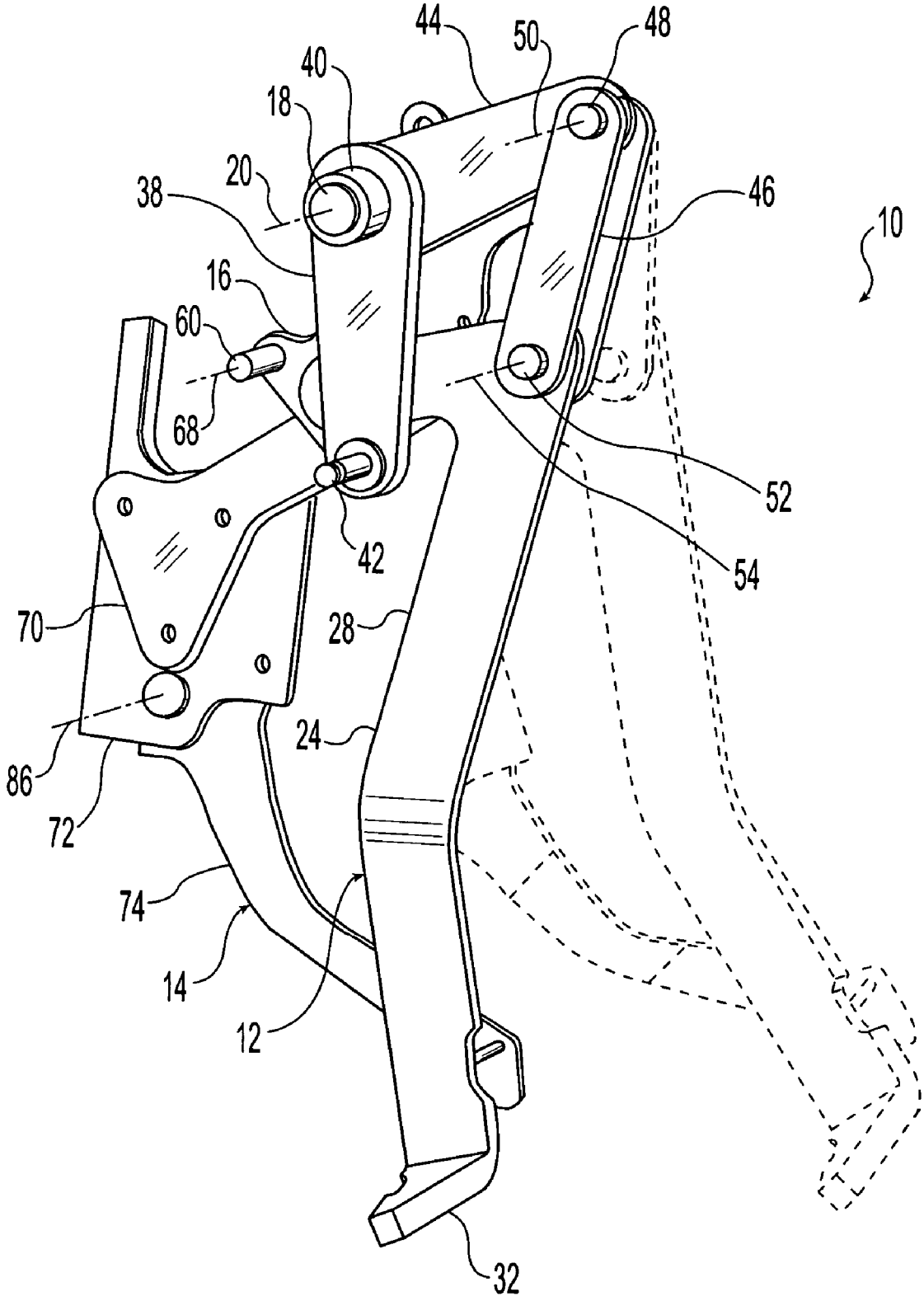
FIG. 4 is a left rear perspective view similar to FIG. 2 but showing the control pedals moved to a full forward position and the full rearward positions shown in phantom line.

As best shown in FIGS. 2 and 4, the position of the brake and accelerator pedals 12, 14 can be adjusted by the operator of the motor vehicle in a forward-rearward direction between a full rearward position (FIG. 2) and a full forward position (FIG. 4). When the pedals 12, 14 can be infinitely positioned at any desired position between these end point positions. By way of example, to move the pedals 12, 14 from the full rearward position to the full forward position, the motor 64 is initiated to rotate the lead screw 58 about its axis of rotation 66 in a direction which causes the drive block 62 to linearly move along the lead screw 58 in the forward direction. The movement of the drive block 62 causes the guide 34 to move along the slot 22 in the forward direction. As the guide 34 moves forward, the brake link 46 pivots about its pivot axes 50, 54 to permit the brake lower arm 24 to move in a forward direction. It is noted that the support link 44, booster link 38, hub 40, and booster pin 42 do not move during this position adjustment so that operation of the vehicle brake system is not affected. As the guide 34 moves forward, the accelerator link 76 also pivots about its pivot axes 80, 84 to permit the accelerator upper arm 70 and attached accelerator mounting bracket 72 to move in a forward direction. It is noted that the accelerator lower arm 74 does not move relative to the accelerator mounting bracket 72 during this position adjustment so that operation of the vehicle throttle system is not affected. It is noted that the motor 64 can be stopped at any time to locate the pedals 12, 14 at any intermediate position. To return the pedals 12, 14 to the full rearward position, the motor 64 rotates the lead screw 58 in the opposite direction to move the components in the opposite direction as described above.

Figure 5:
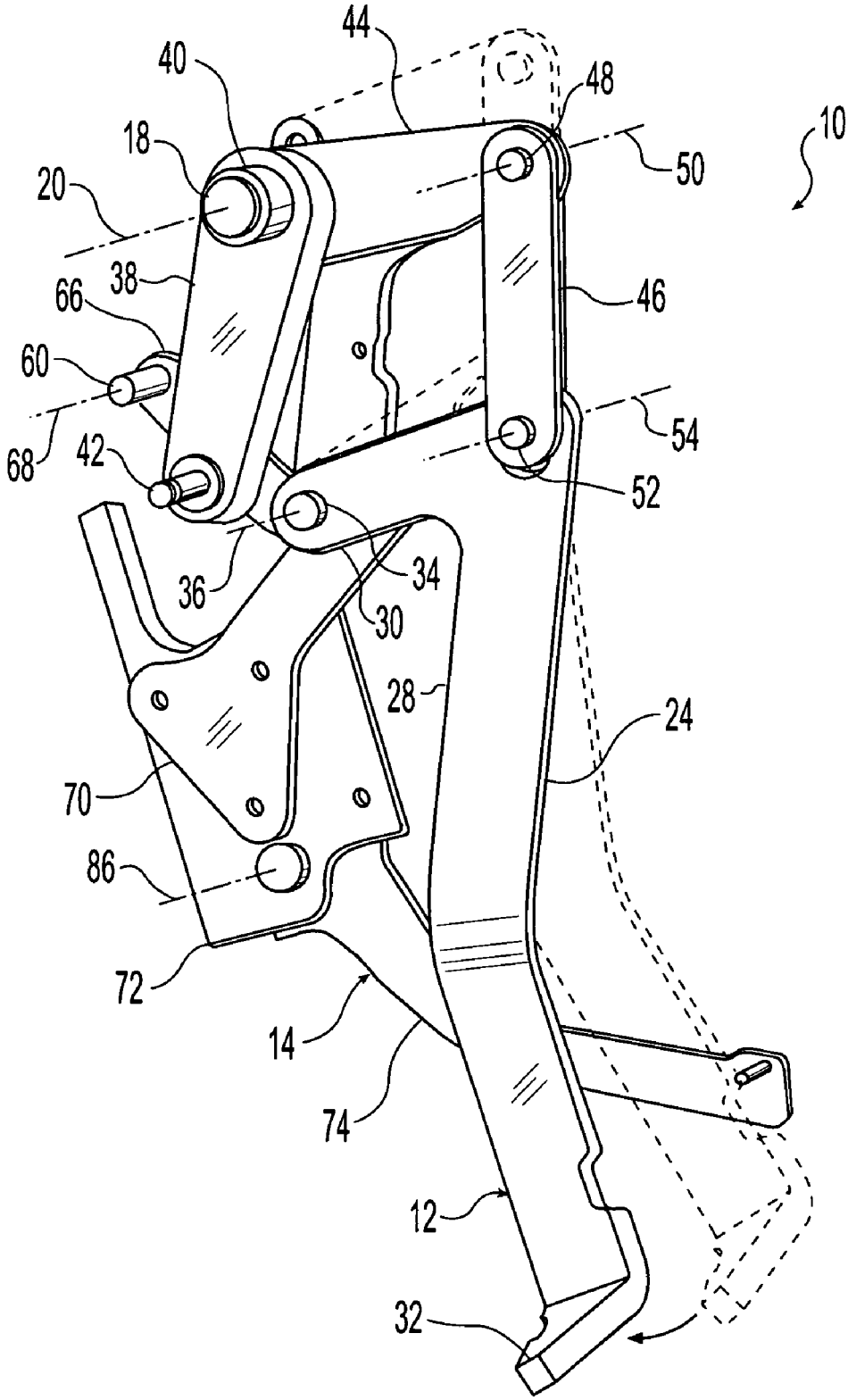
FIG. 5 is left rear perspective view similar to FIG. 2 but showing the brake pedal in an actuated or depressed position and the unactuated or undepressed position shown in phantom line.

As best shown in FIG. 5, the operator depresses the brake pedal 26 during operation of the motor vehicle to engage the brake system of the motor vehicle. When a force is applied to the lower end of the brake lower arm 24, the brake lower arm 24 pivots about the pivot axis 36 formed by the guide 34. The pivoting motion of the brake lower arm 24 downwardly pulls the brake link 46 which in turn downwardly pulls the rearward end of the support link 44 to pivot the support link 44 and the booster link 38 rigidly attached thereto about the pivot axis 20. The pivoting action of the booster link 38 moves the booster pin 42 to operate the vehicle brake system. When the force is removed from the lower end of the brake lower arm 24, a return spring provided in the brake system resiliently pivots the booster link 38 and the support link 44 attached thereto back which pulls the brake link 46 up and pivots the brake lower arm 24 back to its undepressed position. It is noted that alternatively or additionally a return spring can be provided in the pedal assembly 10 which resiliently returns the brake pedal lower arm 24 to the undepressed position when the force is removed.

Figure 6:
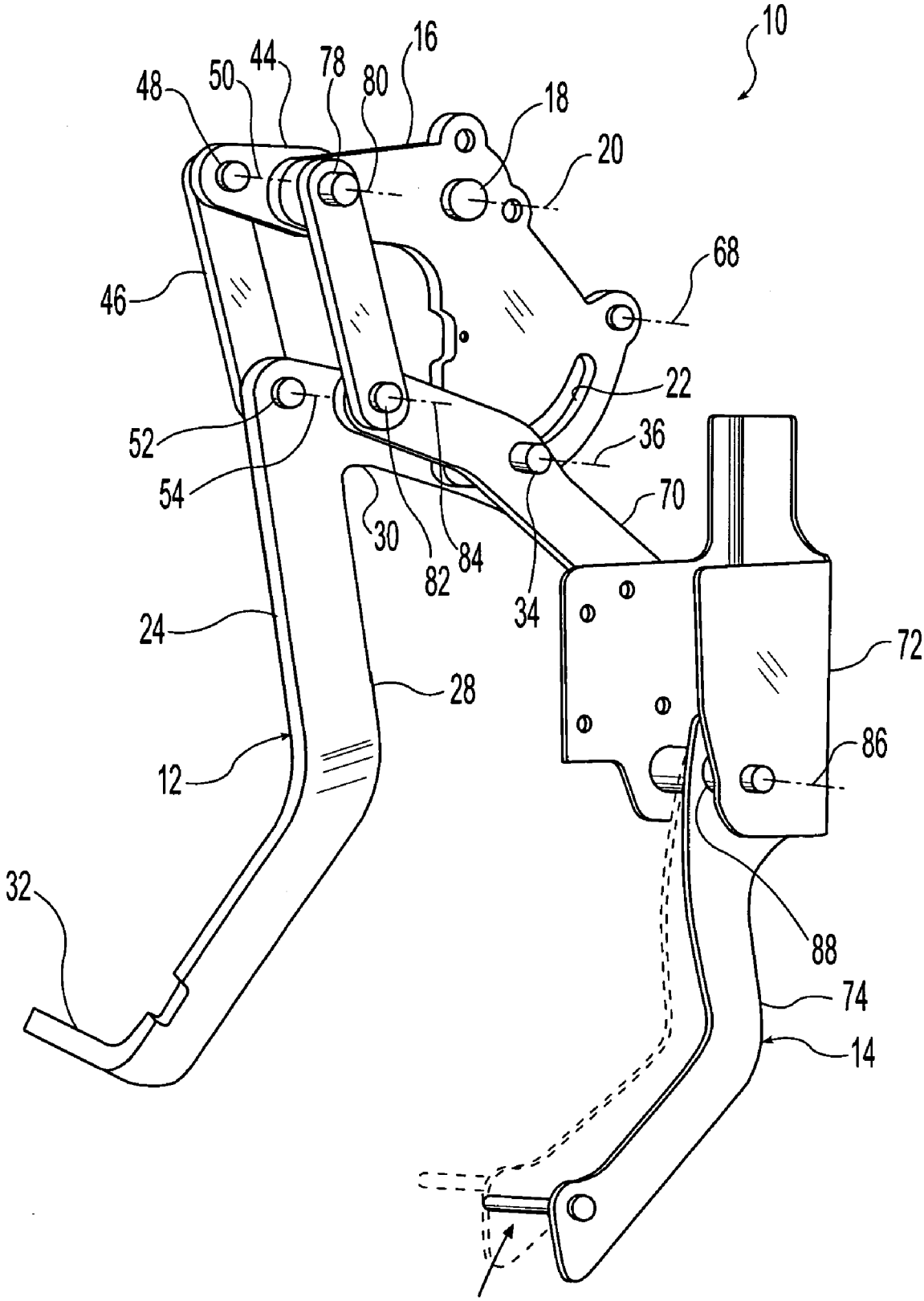
FIG. 6 is right rear perspective view similar to FIG. 1 but showing the accelerator pedal in an actuated or depressed position and the unactuated or undepressed position shown in phantom line.

As best shown in FIG. 6, the operator depresses the accelerator pedal 90 during operation of the motor vehicle to engage the throttle system of the motor vehicle. When a force is applied to the lower end of the accelerator lower arm 74, the accelerator lower arm 74 pivots about the pivot axis 86. The pivoting motion of the accelerator lower arm 74 is sensed by the sensor 88 and the sensor 88 sends an electronic signal to the throttle system brake system. Particularly when the accelerator lower arm 74 bottoms out, forces are applied to the accelerator pedal upper arm 70 which would cause the accelerator upper arm 70 to rotate about the axis 36 formed by the guide 34 if not for the fact that the components are sized and shaped such that the components lock together to prevent any such pivoting of the accelerator upper arm 70 from occurring. When the force is removed from the lower end of the accelerator lower arm 74, a return spring of the accelerator pedal resiliently pivots the accelerator lower arm 74 back to its undepressed position.

From the foregoing disclosure it will be apparent that the present invention provides mechanical step-over control between the accelerator and brake pedals by moving both of the pedals 12, 14 with the same guide 34 so that they are rigidly connected during movement. This eliminates the need for expensive switches and/or sensors which are needed when the pedals 12, 14 are not rigidly connects during movement. The present invention utilizes a single drive system having a single motor 64 to reduce overall operating noise and increase overall reliability. The motor 64 directly drives the single lead screw 58 to eliminate the need for a flex shaft therebetween and thereby improves the efficiency and reliability of the assembly 10 and reduces overall noise of the assembly 10. Additionally, because there is not a flex shaft in the drive system 56, the assembly 10 can run into hard or mechanical stops without flex shaft wind-up. Furthermore, the assembly 10 uses a relatively small number of parts, is relatively low cost to produce and can be operated without the need for a controller in basic systems. Finally, assembly is easily customized to meet varying vehicle or floor pan requirements. For example, the slot can be shaped in manner different configuration to get many different motions of the pedals.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the control pedal assembly can at least partly be operated from a remote control unit such as a keyless entry device. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A control pedal assembly comprising, in combination:
a pivotable booster link;
a fixed-position support having a slot formed therein;
a guide extending into the slot moveable along the slot in a fore aft direction;
wherein the guide forms a laterally extending pivot axis;
a drive assembly operably connected to the guide to selectively move the guide along the slot in a fore-aft direction so that the pivot axis moves in the fore-aft direction;
a first control pedal comprising:
a first lower pedal arm pivotally connected to the guide and pivotable about the pivot axis;
a first pedal at a lower end of the first lower pedal arm which is adjustable in a fore-aft direction upon movement of the guide; and
a first link pivotably connecting the first lower pedal arm with the booster link;
a second control pedal comprising:
an upper pedal arm pivotably connected to the guide;
a second link pivotably connected to the upper pedal arm;
a second lower pedal arm pivotably connected to the upper pedal arm; and
a second pedal at a lower end of the second lower pedal arm which is adjustable in a fore-aft direction upon movement of the guide;
a support link rigidly connected to the booster link;
wherein the first link is pivotably connected to the support link; and
wherein depression of the first pedal pivots the first pedal arm about the pivot axis to pivot the booster link through the first link and the support link.

2. The control pedal assembly according to claim 1, wherein the slot is curved.

3. The control pedal assembly according to claim 1, wherein the support is a generally flat plate with the guide laterally extending therethrough.

4. The control pedal assembly according to claim 3, wherein the first lower arm is pivotably connected to the guide on one side of the plate and the upper arm is pivotably connected to the guide on the other side of the plate.

5. The control pedal assembly according to claim 1, wherein the second link pivotably connects the upper arm to the support.

6. A control pedal assembly comprising, in combination:
a pivotable booster link;
a fixed position support having a slot formed therein;
a guide extending into the slot and moveable along the slot in a fore aft direction;
wherein the guide forms a laterally extending pivot axis;
a drive assembly operably connected to the guide to selectively move the guide along the slot in a fore-aft direction so that the pivot axis moves in the fore-aft direction;
a first control pedal comprising:
a first lower pedal arm pivotally connected to the guide and pivotable about the pivot axis;
a first pedal at a lower end of the first lower pedal arm which is adjustable in a fore-aft direction upon movement of the guide; and
a first link pivotably connecting the first lower pedal arm with the booster link;
a second control pedal comprising:
an upper pedal arm pivotably connected to the guide;
a second link pivotably connected to the upper pedal arm;
a second lower pedal arm pivotably connected to the upper pedal arm; and
a second pedal at a lower end of the second lower pedal arm which is adjustable in a fore-aft direction upon movement of the guide;
a mounting bracket rigidly attached to the upper arm wherein the second lower arm is pivotably attached to the mounting bracket; and
wherein depression of the first pedal pivots the first pedal arm about the pivot axis to pivot the booster link through the first link.

7. The control pedal assembly according to claim 1, wherein the first control pedal is a brake pedal and the second control pedal is an accelerator pedal.

8. The control pedal assembly according to claim 7, wherein the accelerator pedal includes a sensor producing an electronic signal representative of pivoting motion of the second lower pedal arm relative to the upper pedal arm.

9. The control pedal assembly according to claim 1, wherein the drive assembly is a linear drive assembly.

10. The control pedal assembly according to claim 1, wherein the upper pedal arm supports an entire weight of the second lower pedal arm.

11. A control pedal assembly comprising, in combination:
a booster link pivotably mounted at a stationary pivot axis and having a connection for pivotally connecting a system to be operated;
a fixed position support having a slot formed therein;
a guide extending into the slot and moveable along the slot in a fore aft direction;
wherein the guide forms a laterally extending pivot axis;
a drive assembly operably connected to the guide to selectively move the guide along the slot in a fore-aft direction so that the pivot axis moves in the fore-aft direction; and
a control pedal comprising:
a lower pedal arm pivotally connected to the guide and pivotable about the pivot axis;
a pedal at a lower end of the lower pedal arm which is adjustable in a fore-aft direction upon movement of the guide;
a pedal-arm link pivotably connecting the lower pedal arm with the booster link at a location spaced apart from the connection; and
wherein depression of the pedal pivots the pedal arm about the pivot axis to pivot the booster link through the pedal-arm link.

12. The control pedal assembly according to claim 11, further comprising a support link rigidly connected to the booster link and wherein the pedal arm link is pivotably connected to the support link.

13. The control pedal assembly according to claim 11, wherein the slot is curved.

14. The control pedal assembly according to claim 11, wherein the support is a generally flat plate with the guide laterally extending therethrough.

15. The control pedal assembly according to claim 11, wherein the control pedal is a brake pedal.

16. The control pedal assembly according to claim 11, wherein the drive assembly is a linear drive assembly.

17. The control pedal assembly according to claim 11, further comprising another control pedal comprising:

an upper pedal arm pivotably connected to the guide;

another link pivotably connected to the upper pedal arm;

another lower pedal arm pivotably connected to the upper pedal arm; and another pedal at a lower end of the another lower pedal arm which is adjustable in a fore-aft direction upon movement of the guide.

18. The control pedal assembly according to claim 17, further comprising a mounting bracket rigidly attached to the upper arm wherein the another lower arm is pivotably attached to the mounting bracket.

19. The control pedal assembly according to claim 17, wherein another control pedal is an accelerator pedal.

20. The control pedal assembly according to claim 19, wherein the accelerator pedal includes a sensor producing an electronic signal representative of pivoting motion of the another lower pedal arm relative to the upper pedal arm.

21. The control pedal assembly according to claim 17, wherein the upper pedal arm supports an entire weight of the another lower pedal arm.

22. A control pedal assembly comprising, in combination:

a fixed-position support having a slot formed therein;

a guide extending into the slot and moveable along the slot in a fore aft direction;

wherein the guide forms a laterally extending pivot axis:

a drive assembly comprising:

a lead screw connected to the support;

a drive nut secured to the guide and cooperating with the lead screw for linear movement along the lead screw upon rotation of the lead screw; and a drive motor operably connected to lead screw for selectively rotating the lead screw to move the drive nut along the lead screw so that the pivot axis moves in the fore-aft direction;

a first control pedal comprising:

a first lower pedal arm secured to the drive nut and pivotable about the pivot axis; and a pedal at a lower end of the lower pedal arm which is adjustable in a fore-aft direction upon movement of the drive nut along the lead screw;

a second control pedal comprising:

an upper pedal arm secured to the drive nut;

a second lower pedal arm pivotably connected to the upper pedal arm; and a second pedal at a lower end of the second lower pedal arm which is adjustable in a fore-aft direction upon movement of the drive nut along the lead screw;

a mounting bracket rigidly attached to the upper pedal arm wherein the second lower arm is pivotably attached to the mounting bracket; and wherein depression of the first pedal pivots the first pedal arm about the pivot axis to pivot the booster link.

23. The control pedal assembly according to claim 22, wherein the first lower pedal arm and the upper pedal arm are each pivotably secured to the drive nut.

24. The control pedal assembly according to claim 22, wherein the first lower pedal arm and the upper pedal arm are each secured to the drive nut in a manner in which a predetermined fore-aft relationship between the first lower pedal arm and the upper pedal arm is maintained during movement of the drive nut along the lead screw.

25. The control pedal assembly according to claim 22, wherein the support has a slot formed therein, and a guide is secured to the drive nut so that the guide is moveable along the slot in a fore aft direction upon movement of the drive nut.

26. The control pedal assembly according to claim 25, wherein the support is a generally flat plate with the guide laterally extending therethrough.

27. The control pedal assembly according to claim 26, wherein the first lower arm is connected to the guide on one side of the plate and the upper arm is connected to the guide on the other side of the plate.

28. The control pedal assembly according to claim 25, wherein the slot is curved.

29. The control pedal assembly according to claim 22, further comprising a booster link pivotably mounted at a fixed pivot axis, a first link pivotably connecting the first lower pedal arm with the booster link, and a second link pivotably connected to the upper pedal arm.

30. A control pedal assembly comprising, in combination:

a fixed-position support having a slot formed therein;

a guide extending into the slot and moveable along the slot in a fore aft direction;

wherein the guide forms a laterally extending pivot axis;

a drive assembly comprising:

a lead screw connected to the support;

a drive nut secured to the guide and cooperating with the lead screw for linear movement along the lead screw upon rotation of the lead screw; and a drive motor operably connected to lead screw for selectively rotating the lead screw to move the drive nut along the lead screw so that the pivot axis moves in the fore-aft direction;

a first control pedal comprising:

a first lower pedal arm secured to the drive nut and pivotable about the pivot axis; and a pedal at a lower end of the lower pedal arm which is adjustable in a fore-aft direction upon movement of the drive nut along the lead screw;

a second control pedal comprising:

an upper pedal arm secured to the drive nut;

a second lower pedal arm pivotably connected to the upper pedal arm; and a second pedal at a lower end of the second lower pedal arm which is adjustable in a fore-aft direction upon movement of the drive nut along the lead screw;

a booster link pivotably mounted at a fixed pivot axis, a first link pivotably connecting the first lower pedal arm with the booster link, and a second link pivotably connected to the upper pedal arm; and a support link rigidly connected to the booster link and wherein the first link is pivotably connected to the support link; and wherein depression of the first pedal pivots the first pedal arm about the pivot axis to pivot the booster link through the first link and the support link.

31. The control pedal assembly according to claim 29, wherein the second link pivotably connects the upper arm to the support.

32. The control pedal assembly according to claim 22, wherein the first control pedal is a brake pedal and the second control pedal is an accelerator pedal.

33. The control pedal assembly according to claim 32, wherein the accelerator pedal includes a sensor producing an electronic signal representative of pivoting motion of the second lower pedal arm relative to the upper pedal arm.

34. The control pedal assembly according to claim 22, wherein the upper pedal arm supports an entire weight of the second lower pedal arm.

35. The control pedal assembly according to claim 34, wherein the upper pedal arm is pivotably secured to the drive nut and the upper pedal arm is configured to prevent the upper pedal arm from pivoting relative to the drive nut when a force is applied to the second pedal to pivot the second lower pedal arm relative to the upper pedal arm.

36. A control pedal assembly comprising, in combination:

a booster link pivotably mounted at a stationary pivot axis;

a fixed-position support having a slot formed therein;

a guide extending into the slot and moveable along the slot in a fore aft direction;

wherein the guide forms a laterally extending pivot axis;

a drive assembly comprising:

a lead screw;

a drive nut secured to the guide and cooperating with the lead screw for linear movement along the lead screw upon rotation of the lead screw; and a drive motor operably connected to lead screw for selectively rotating the lead screw to move the drive nut along the lead screw;

wherein movement of the drive nut along the drive screw moves the guide along the slot in a fore-aft direction so that the pivot axis moves in the fore-aft direction;

a brake pedal comprising:

a brake lower pedal arm pivotally connected to the drive nut and pivotable about the pivot axis;

a first pedal at a lower end of the brake lower pedal arm which is adjustable in a fore-aft direction upon movement of the guide; and a brake link pivotably connecting the brake lower pedal arm with the booster link;

an accelerator pedal comprising:

an accelerator upper pedal arm pivotably connected to the drive nut;

an accelerator link pivotably connecting the accelerator upper pedal arm to the support;

an accelerator lower pedal arm pivotably connected to the accelerator upper pedal arm; and a second pedal at a lower end of the second lower pedal arm which is adjustable in a fore-aft direction upon movement of the guide; and wherein depression of the first pedal pivots the first pedal arm about the pivot axis to pivot the booster link through the first link and the support link.

* * * * *